US006504296B2

(12) United States Patent
Burkhardt et al.

(10) Patent No.: US 6,504,296 B2
(45) Date of Patent: Jan. 7, 2003

(54) TUBE NECK FOR CATHODE RAY TUBE

(75) Inventors: Klaus Burkhardt, Kraichtal (DE); Wolfgang Eckhardt, Karlsruhe (DE)

(73) Assignee: Siemens Aktiengesellschaft, Munich (DE)

( * ) Notice: Subject to any disclaimer, the term of this patent is extended or adjusted under 35 U.S.C. 154(b) by 13 days.

(21) Appl. No.: 09/893,001

(22) Filed: Jun. 28, 2001

(65) Prior Publication Data

US 2002/0003395 A1 Jan. 10, 2002

Related U.S. Application Data

(63) Continuation of application No. PCT/DE99/04061, filed on Dec. 21, 1999.

(30) Foreign Application Priority Data

Dec. 28, 1998 (DE) ..... 298 23 118

(51) Int. Cl.[7] ..... H01J 29/86; H01J 29/48
(52) U.S. Cl. ..... 313/448; 313/450; 313/477 HC
(58) Field of Search ..... 313/448–450, 313/458, 477 HC, 479

(56) References Cited

U.S. PATENT DOCUMENTS

| | | | | |
|---|---|---|---|---|
| 3,383,537 A | | 5/1968 | Marshall | |
| 3,919,583 A | * | 11/1975 | Hasker et al. | 313/448 |
| 4,268,712 A | | 5/1981 | Overall | 174/50.63 |
| 4,268,777 A | * | 5/1981 | van Roosmalen | 313/448 X |
| 4,350,925 A | | 9/1982 | Marschka | 313/451 |
| 4,585,976 A | * | 4/1986 | Reed | 313/448 X |
| 5,894,190 A | * | 4/1999 | Hirota et al. | 313/448 X |

FOREIGN PATENT DOCUMENTS

| | | | |
|---|---|---|---|
| DE | 26 49 617 A1 | 5/1977 | H01J/5/06 |
| DE | 198 24 783 A1 | 12/1999 | H01J/37/12 |
| EP | 0 302 657 A2 | 2/1989 | H01J/29/50 |
| JP | 60-182646 A | 9/1985 | H01J/29/48 |
| JP | 60218743 | 11/1985 | H01J/29/48 |

* cited by examiner

*Primary Examiner*—Ashok Patel
(74) *Attorney, Agent, or Firm*—Sughrue Mion, PLLC

(57) ABSTRACT

In order to improve the definition and the breakdown behavior in a tube neck (16) that includes an anode cylinder (20) and a focusing cylinder (19), the tube neck (16) is made of a non-conductive material, particularly a ceramic. The inner surface of the anode cylinder (20) and the inner surface and the outer surface of the focusing cylinder (19) are coated with an electrically conductive material (21).

7 Claims, 4 Drawing Sheets

TUBE NECK FOR CATHODE RAY TUBE

This is a Continuation of International Application PCT/DE99/04061, with an international filing date of Dec. 21, 1999 which was published under PCT Article 21(2) in German, and the complete disclosure of which is incorporated into this application by reference.

FIELD OF AND BACKGROUND OF THE INVENTION

The present invention relates to a tube neck for a cathode ray tube having an anode cylinder and a focusing cylinder. The invention further relates to a cathode ray tube.

Conventional cathode ray tubes are usually provided with a tube neck, which is made of glass and which has a metallic anode cylinder and a metallic focusing cylinder. The anode cylinder and the focusing cylinder form part of a known electron gun, which includes a cathode, a control grid, and a screen grid that is arranged downstream from the control grid. Particularly in the case of high-resolution monitors it is necessary to arrange the focusing cylinder concentrically inside the anode cylinder in order to ensure adequate definition.

German Patent Application 198 24 783.4 proposes an electrode arrangement, which includes several electrodes and which serves as an electron gun for focusing an electron beam. This electrode arrangement is monolithically made from several ceramic layers.

OBJECTS OF THE INVENTION

It is one object of the present invention to provide a tube neck that permits an improved definition and an improved high voltage breakdown behavior of the tube.

SUMMARY OF THE INVENTION

This and other objects are achieved by providing a tube neck for a cathode ray tube, wherein the tube neck is made of a non-conductive material, and wherein the tube neck includes an anode cylinder and a focusing cylinder, and is provided with an electrically-conductive material. The tube neck simultaneously forms the anode cylinder and the focusing cylinder. The inside of the anode cylinder and the inside and the outside of the focusing cylinder are coated with the electrically conductive material.

In an advantageous embodiment of the invention, the tube neck is provided with a recess, which has a terminal for applying a focusing voltage to the focusing cylinder.

In a further embodiment of the invention, the terminal is provided with an opening by means of which a vacuum can be produced inside the cathode ray tube.

BRIEF DESCRIPTION OF THE DRAWINGS

The invention and further advantageous refinements of the invention according to the features of the dependent claims are explained in more detail below with the aid of diagrammatic, exemplary embodiments in the drawings, in which:

DETAILED DESCRIPTION OF THE PREFERRED EMBODIMENTS

Figure 4:
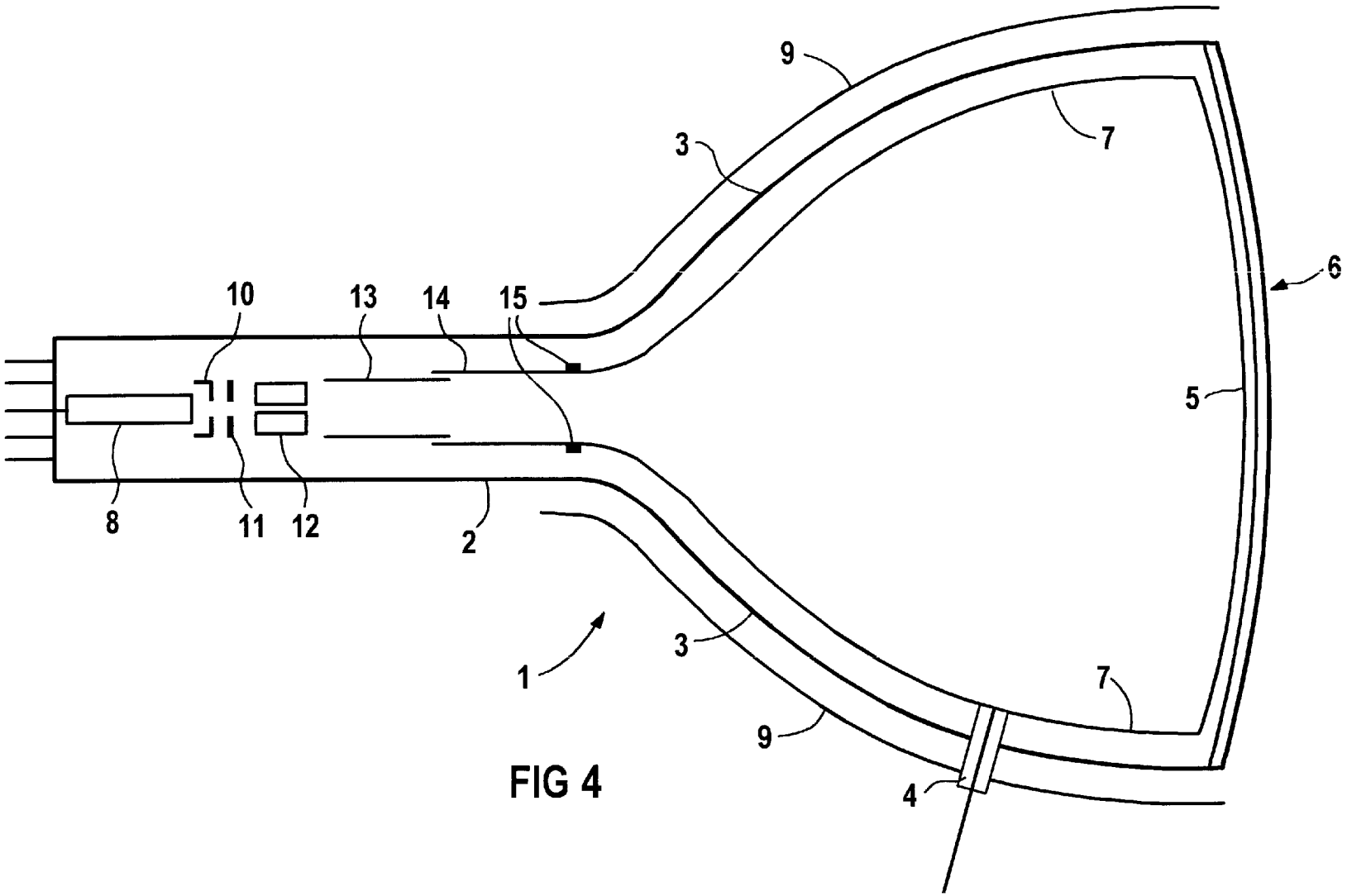
FIG. 4 shows a schematic diagram of a conventional cathode ray tube.

Reference is first made to FIG. 4. A glass bulb 1 of a cathode ray tube essentially includes a tube neck 2; a funnel-shaped part 3, which is provided with an anode terminal 4; and a tube bottom 6, which is provided with a fluorescent coating 5. An inner coating of the glass bulb 1 includes an electrically conductive coating, e.g., an aluminum coating 7, which serves to divert the electrons emitted by a cathode 8 onto the fluorescent coating 5. Furthermore, an outer coating includes a graphite layer 9. The graphite layer 9 and the aluminum layer 7 constitute a capacitor, which serves to smooth the anode voltage. An electron gun is arranged in the tube neck 2 and includes the cathode 8, a control grid 10, a screen grid 11 arranged downstream from control grid 10, and a focusing unit 12. The tube neck 2 includes a focusing cylinder 13, which is made of sheet metal parts, and an anode cylinder 14, which is connected with the aluminum layer 7 via terminals 15.

Figure 1:
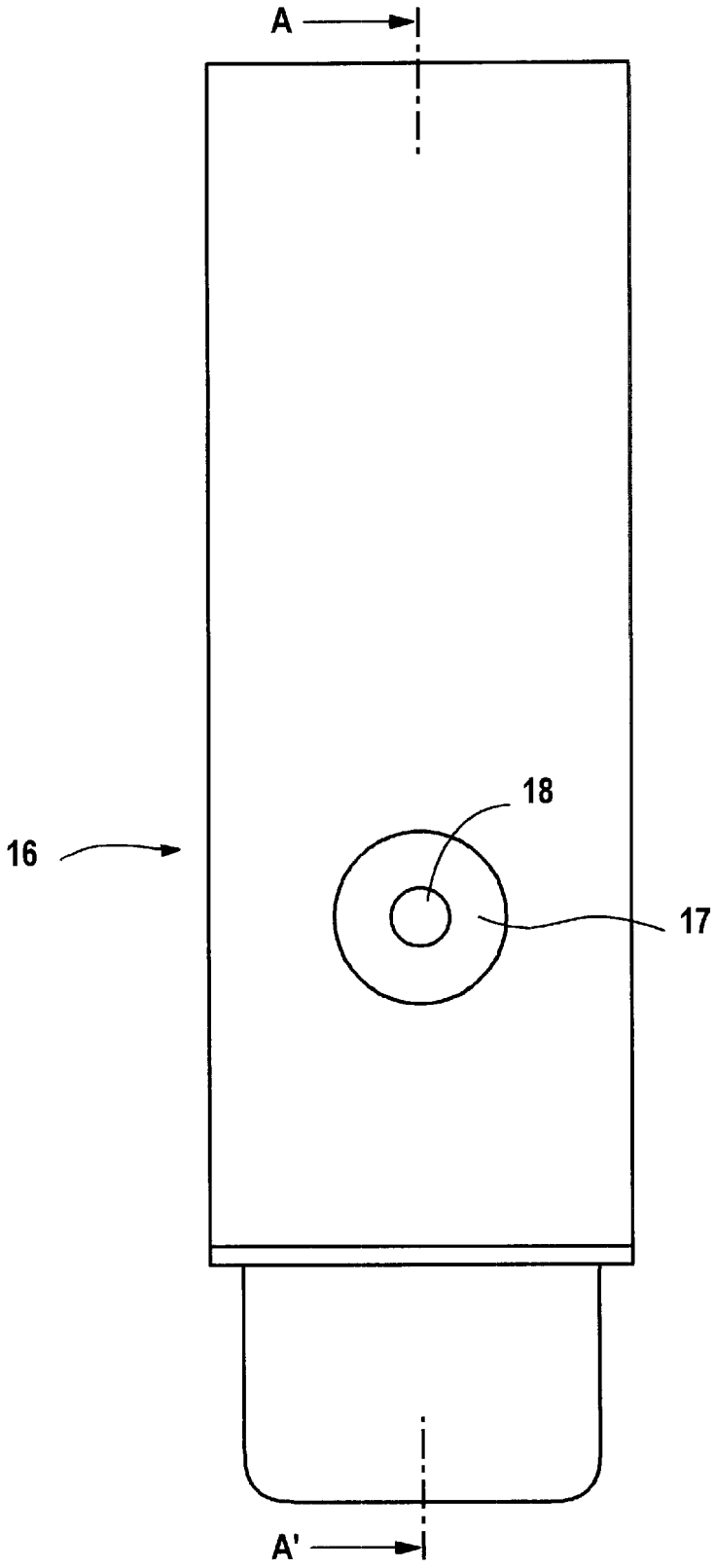
FIG. 1 shows a side view of the tube neck in accordance with an embodiment of the present invention.

Reference is now made to FIG. 1, which depicts a side view of a cylindrical tube neck 16 made of a ceramic material, according to a first embodiment of the invention. The tube neck 16 has a substantially conical recess 17, which is provided with a metallic layer. This metallic layer makes it possible to apply a focusing voltage to a focusing cylinder of the tube neck 16. A ball 18 can be inserted into the conical recess 17 to seal the tube hermetically after evacuation of the cathode ray tube.

Figure 2:
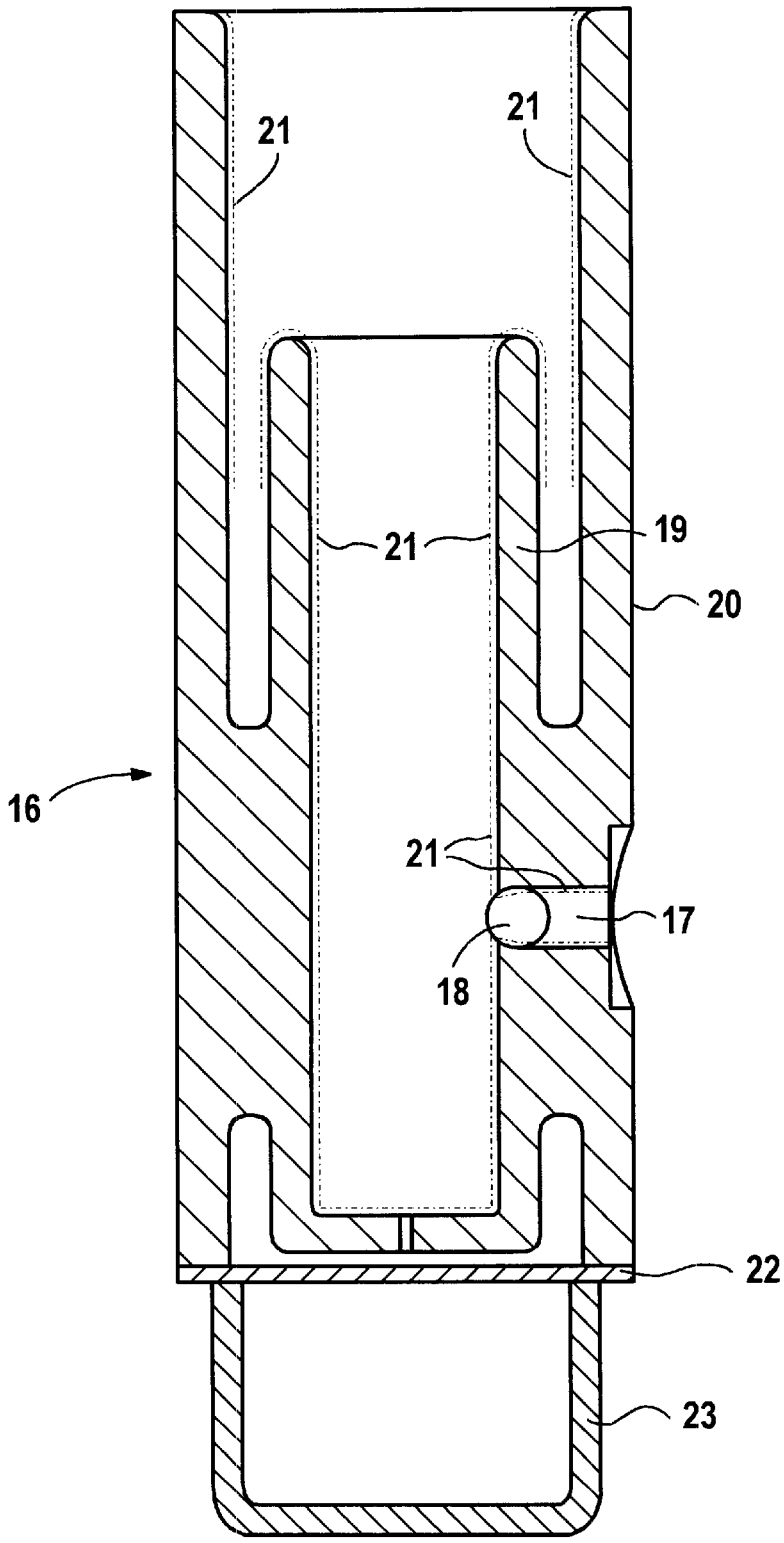
FIG. 2 shows a section view of the tube neck in accordance with an embodiment of the present invention.
Figure 3:
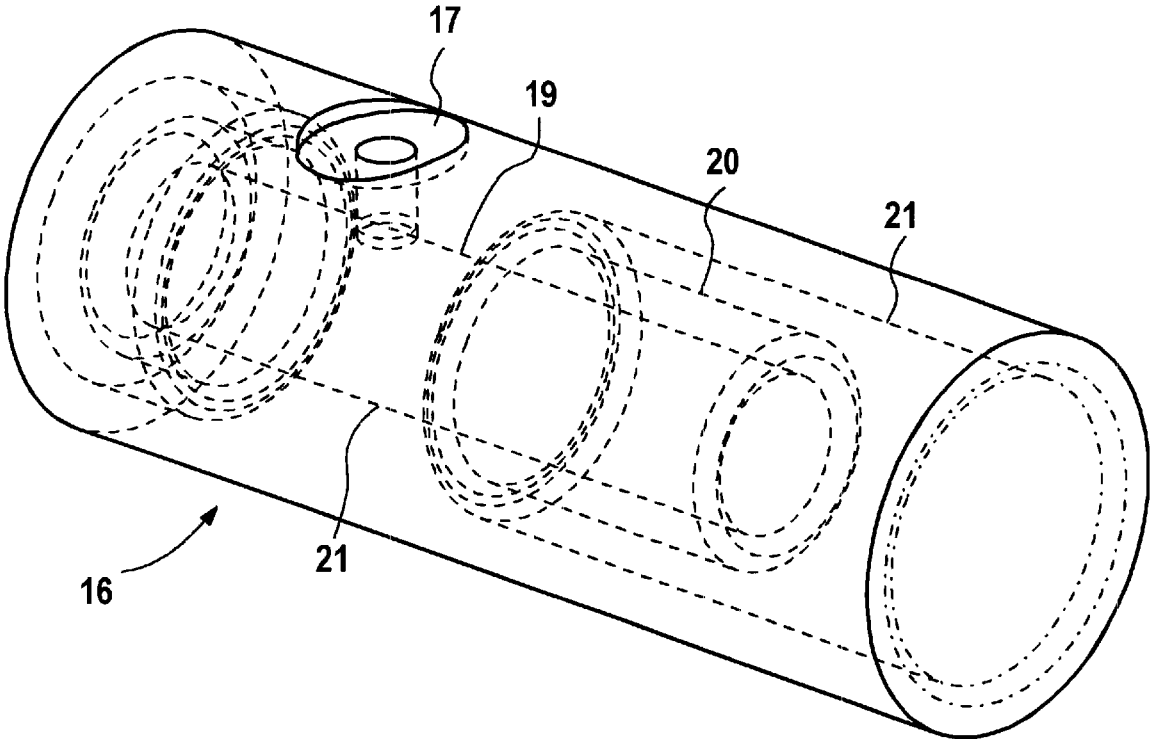
FIG. 3 shows a perspective view of the tube neck in accordance with an embodiment of the present invention.

Reference is now made to FIGS. 2 and 3. FIG. 2 shows a cross section along line A—A' in FIG. 1 and FIG. 3 shows a perspective view of the tube neck 16 depicted in FIG. 1. Identical parts in FIGS. 1, 2 and 3 carry the same reference numbers. The tube neck 16 includes a focusing cylinder 19 and an anode cylinder 20. The anode cylinder 20, along its inner surface, and the focusing cylinder 19, along its inner surface and outer surface, are coated with an electrically conductive material 21. Using a ceramic material for producing the tube neck 16 allows for a simple production of flat surfaces of the focusing cylinder and the anode cylinder 19, 20. This means that such a tube neck in a cathode ray tube provides very good definition. The lateral surfaces of the recess 17 are also coated with the electrically conductive material 21, via which a focusing voltage can be supplied to the focusing cylinder 19. The tube neck 16 preferably includes a ceramic electrode arrangement 22 as proposed in German Patent Application 198 24 783. 4, which is provided for focusing the electron beam. A cylindrical ceramic end cap 23 hermetically seals the tube neck and the cathode ray tube.

The above description of the preferred embodiments has been given by way of example. From the disclosure given, those skilled in the art will not only understand the present invention and its attendant advantages, but will also find apparent various changes and modifications to the structures disclosed. It is sought, therefore, to cover all such changes and modifications as fall within the spirit and scope of the invention, as defined by the appended claims, and equivalents thereof.

What is claimed is:

1. A tube neck for a cathode ray tube, comprising:

an anode cylinder;

a focusing cylinder; and an electrically conductive material;

wherein the tube neck is made of a non-conductive material that forms the anode cylinder and the focusing cylinder; and wherein an inner surface of the anode cylinder and an inner surface and an outer surface of the focusing cylinder are coated with the electrically conductive material.

2. The tube neck as claimed in claim 1, wherein the non-conductive material comprises a ceramic material.

3. The tube neck as claimed in claim 1, further comprising a recess having a terminal for applying a focusing voltage to the focusing cylinder.

4. The tube neck as claimed in claim 3, wherein the terminal has an opening for evacuating the cathode ray tube.

5. The tube neck as claimed in claim 3, wherein the recess is substantially conical;

and wherein the recess has a metallic layer for applying the focusing voltage.

6. The tube neck as claimed in claim 5, further comprising substantially spherical sealing means inserted into the recess for hermetically sealing the cathode ray tube.

7. A cathode ray tube, comprising:

a tube neck, comprising:

an anode cylinder of non-conductive material;

a focusing cylinder of non-conductive material; and an electrically conductive material;

wherein the tube neck is an integral element forming the anode cylinder and the focusing cylinder; and wherein an inner surface of the anode cylinder and an inner surface and an outer surface of the focusing cylinder are coated with the electrically conductive material.

* * * * *